US005728496A

United States Patent [19]

Rimai et al.

[11] Patent Number: 5,728,496

[45] Date of Patent: Mar. 17, 1998

[54] ELECTROSTATOGRAPHIC APPARATUS AND METHOD FOR IMPROVED TRANSFER OF SMALL PARTICLES

[75] Inventors: Donald S. Rimai, Webster; Paul M. Borsenberger, Hilton; Salvatore Leone; Marie B. O'Regan, both of Rochester; Thomas N. Tombs, Brockport, all of N.Y.

[73] Assignee: Eastman Kodak Company, Rochester, N.Y.

[21] Appl. No.: 653,518

[22] Filed: May 24, 1996

[51] Int. Cl.[6] ..... G03G 13/01; G03G 13/16

[52] U.S. Cl. ..... 430/47; 430/126

[58] Field of Search ..... 430/47, 126

[56] References Cited

U.S. PATENT DOCUMENTS

| | | | |
|---|---|---|---|
| 3,697,171 | 10/1972 | Sullivan | 430/126 |
| 4,737,433 | 4/1988 | Rimai et al. | 430/126 |
| 4,845,001 | 7/1989 | Takei et al. | 430/66 |
| 5,059,502 | 10/1991 | Kojima et al. | 430/66 |
| 5,084,735 | 1/1992 | Rimai et al. . | |
| 5,168,023 | 12/1992 | Mitani et al. | 430/58 |
| 5,187,526 | 2/1993 | Zaretsky . | |
| 5,215,852 | 6/1993 | Kato et al. | 430/126 |
| 5,233,396 | 8/1993 | Simms et al. . | |
| 5,240,801 | 8/1993 | Hayashi et al. | 430/57 |
| 5,242,775 | 9/1993 | Yamazaki | 430/66 |
| 5,262,262 | 11/1993 | Yagi et al. | 430/66 |
| 5,370,961 | 12/1994 | Zaretsky et al. | 430/126 |
| 5,485,256 | 1/1996 | Randall et al. | 430/44 |

OTHER PUBLICATIONS

"Application of Diamondlike Carbon Films to the Protective Layer of Organic Photoconductors", Nakaue, Mitani and Kurokawa, Diamond Films and Technology 3, 45 (1993).

*Primary Examiner*—Roland Martin
*Attorney, Agent, or Firm*—Norman Rushefsky

[57] ABSTRACT

Unexpectedly good transfer of electrophotographically-produced images using small toner particles occurs when the image is developed on an electrostatographic recording member, preferably an organic photoconductive element, which has been overcoated with a thin (about 10 nm to about 10 μm thick) layer of a material having a Young's modulus greater than 10 GPa and preferably greater than about 100 GPa. The image is then transferred to an intermediate member which is comprised of an elastomeric blanket between about 0.1 and about 3 cm thick, having a Young's modulus between about 0.5 MPa and about 50 MPa, and preferably between about 1 and about 10 MPa, and having an electrical resistivity between about $10^6$ ohm-cm and about $10^{12}$ ohm-cm, by applying an appropriate electrostatic potential between the transfer intermediate member and the photoconductive element. The toned image is transferred from the intermediate transfer member to the receiver by applying an electrostatic field between the receiver and the intermediate transfer member. The blanket material comprising the intermediate transfer member should be overcoated with a thin (between about 0.1 μm and about 25 μm thick) layer of a material having a Young's modulus greater than about 100 MPa and preferably greater than about 1 GPa.

26 Claims, 8 Drawing Sheets

ELECTROSTATOGRAPHIC APPARATUS AND METHOD FOR IMPROVED TRANSFER OF SMALL PARTICLES

BACKGROUND OF INVENTION

1. Field of the Invention

This invention relates to the production of high quality images produced using a dry electrostatographic process and is especially suited for the production of color images, although it can be used to make black and white images or images containing so-called "spot colors".

2. Description Relative to the Prior Art

Dry electrophotography (also known as xerography and hereafter referred to simply as electrostatography, an example of which is electrophotography) is a technology that has been used in copiers for many years. More recently, the use of such technology for other purposes such as printing electronic files, color printing and proofing, and photofinishing, has also been demonstrated. However, these and other emerging technologies require higher image quality, thereby mandating the use of smaller toner particles, than has been required for conventional copier applications.

In a typical electrophotographic engine, a photoconductive element is initially electrically charged uniformly by a device such as a corona or a roller charger. Suitable photoconductive elements are comprised of materials such as selenium or α-silicon, although better image quality is generally achieved with organic photoconductors. An electrostatic latent image is then formed on the photoconductive element by image-wise exposing said element using either an optical exposure or using an electronic scanner incorporating an LED array, a laser, a light-bar, or other suitable addressable means. The electrostatic latent image is then developed by an electrophotographic developer. Typically, this is accomplished by bringing the latent image bearing photoconductive element into close proximity with a development station containing the electrophotographic developer. Although various types of developers and development stations exist, most typically the developer is comprised of magnetic carrier particles against which pigmented marking or toner particles tribocharge. This developer is contained in a development station comprised of magnets contained within a cylinder, whereby the magnetic core, the containment cylinder, or both can rotate. This rotation allows the tribocharged toner to contact the latent image bearing photoconductive element and adhere to regions corresponding to the electrostatic latent image, thereby developing the electrostatic latent image into a visible image.

The developed image must now be transferred from the photoconductive element to an appropriate image receiver sheet such as paper, transparency stock, clay coated paper, or polymer coated paper. Although several methods of transfer are known, including those using heat, pressure, or the combination thereof, strippable adhesive layers, etc., the preferred mode of transfer incorporates the use of an electrostatic field to urge the tribocharged toner particles from the photoconductive element to the receiver. The electrostatic field is generated by using either a biased roller or a corona charger. After transferring the toned image to the receiver, the image is permanently fixed to the receiver using a suitable technology such as thermally fusing the toner. The photoconductive element is then cleaned and is ready to use again to produce a new image.

As used herein, the term "toner size" refers to the average volume weighted diameter of a spherical particle of the same mass density. Such measurements can be made using commercially available equipment such as a Coulter counter. The term "transfer" will refer to the transfer of the toner particles from one member (e.g. the photoconductive element) to another member (e.g. the receiver) by the application of a suitable electric field. The term "small" as it relates to toner size shall be construed to mean that the mean volume weighted diameter of the toner particles is between about 2 μm and below about 8 μm.

As is well known, image quality of electrophotographically produced images is limited by the size of the toner particles. Specifically, image quality attributes such as granularity and mottle increase with increasing toner size, whereas resolution decreases. Accordingly, it would appear advantageous to use toner particles which are as small as possible. However, as discussed by Rimai and Chowdry in U.S. Pat. No. 4,737,433, it is difficult to electrostatically transfer small toner particles from a photoconductive element to a receiver. This is because, as the size of the toner particles decreases, there is a tendency of surface forces to dominate over the applied electrostatic transfer forces. For all practical purposes the surface forces prevent efficient transfer of toner particles smaller than approximately 12 μm.

In recent years, there have been several methods demonstrated which help to reduce the surface forces holding toner particles to photoconductive elements. One of these methods involves the use of toner particles which bear submicrometer particles, such as silica, latex, barium titanate, etc., on the surface of the toner particles. These submicrometer particles protrude slightly from the surface of the toner particle and serve to prevent the toner particles from contacting the photoconductive element, thereby reducing the surface forces. By using this technology, it has been possible to reduce the size of the transferable toner particles to approximately 8–9 μm. Although the resulting image quality obtained with these toner particles is better than that obtained with the larger particles, these surface treated particles are still too large to allow high quality images, needed for the applications discussed previously, to be made.

An alternative technology uses photoconductors which have been coated with special abhesive or particle releasing layers such as Teflon or other fluorinated hydrocarbons, silicones, or salts of fatty acids such as zinc stearate. This technique has allowed smaller toner particles to be transferred. However, such coatings tend to make the developers unstable and often result in image artifacts such as mottle. Moreover, these coatings do not last and have to be reapplied periodically, which is a complicated process.

In the aforementioned U.S. Pat. No. 4,737,433, there is disclosed that electrophotographic images made with small toner particles could be transferred with high efficiency if monodisperse toner particles and smooth receivers and photoconductors were used. This is believed to be due to the ability to balance the surface forces holding the toner particles to the photoconductive element with those pulling the particles to the receiver. However, surface irregularities introduced by polydisperse toner sizes, receiver roughness, and tentpoles introduced by the presence of dust, carrier, etc. often preclude the use of this technique by preventing the toner particles from contacting either the receiver or other toner particles and, thereby, requiring that the applied electrostatic transfer forces be sufficiently great so as to overcome the surface forces. As discussed, this is frequently not feasible for small toner particles.

Rimai et al in U.S. Pat. No. 5,084,735 and Zaretsky in U.S. Pat. No. 5,187,526 disclose that good transfer can be obtained using a semi-conducting, compliant roller comprised of a relatively thick, low elastic modulus blanket and a relatively thin, higher elastic modulus overcoat. Moreover, Zaretsky and Gomes disclose in U.S. Pat. No. 5,370,961 that, by combining this intermediate with toner particles having small particulate addenda attached to the surfaces of the toner particles, good electrostatic transfer could be achieved of toned images made using small toner particles. Rimai et al in U.S. Pat. No. 5,084,735, which is incorporated by reference by Zaretsky and Gomes, also discloses the use of a photoconductive element which has been overcoated with a release agent to improve transfer to the compliant intermediate. However, as noted above, such release agents also have their disadvantages.

It is frequently preferred to use organic photoconductive elements in electrophotographic engines rather than the more traditional inorganic photoconductive elements such as selenium and α-silicon. Organic photoconductors comprise a photoconductive element that employs an organic polymeric binder. Typically, the binder is a polyester although other polymers can be used. However, organic photoconductors have lower Young's moduli than do inorganic photoconductors (typically 3 GPa vs. 100 GPa, wherein GPa is a gigapascal or $10^9$ Newtons per square meter) and, therefore, are more easily damaged in use than are the inorganic photoconductive elements. As used herein the values of Young's moduli provided are derived from literature sources. Accordingly, organic photoconductive elements have been known to be overcoated with a thin (typically less than 10 μm thick) layer of a higher Young's modulus material such as diamond-like carbon (DLC), silicon carbide (SiC) or a sol-gel. These materials all have Young's moduli greater than 10 GPa and, generally, closer to 100 GPa. These materials are not, however, abhesive or release agents as are materials such as fluorinated hydrocarbons, siloxanes, or salts of fatty acids.

As noted above, in transferring small particles the surface forces holding the particles tend to dominate the applied electrostatic transfer forces. Thus, in designing a transfer system for small particles, it is preferred to employ low surface energy materials which would intuitively exclude consideration of using an organic photoconductor that is overcoated with known hard overcoat materials which are not considered low surface energy materials. For this reason, and with reference to FIG. 10, which shows the transfer efficiencies measured for a variety of toner particles directly (i.e., without the use of a transfer intermediate) from photoconductors which have and have not been overcoated with hard overcoat materials, a mindset has developed in the art that transfer efficiency is likely to suffer when photoconductors coated with a hard overcoat are used in systems for transferring small toner particles.

FIG. 10 illustrates results of an experiment wherein average transfer efficiency is compared between two photoconductors for each of three types of developers. In this experiment, a commercially used organic photoconductor belt PC-A without a hardened overcoat has density patches formed thereon, through say an imaging and development process, and this developed material on the photoconductor is transferred to a paper sheet supported on a high resistivity polyurethane transfer roller ($8.6\times10^9$ ohm-cm). The toner transferred to the paper sheet is compared with the toner remaining on the belt. Separate runs were made using relatively small toner particles (5 μm). In each run, different types of toner particles were used; i.e., toner particles formed by grinding, toner particles of spherical shape and toner particles of irregular shape. In each case, average transfer efficiency for the respective toner particle runs averaged 90% or above. The same experiment was run using a similar organic photoconductor referred to as "PC-A+HOC" which was overcoated with a hardened overcoat. As can be seen in each case transfer efficiency suffered, as expected, when the photoconductor with the hardened overcoat was used with this transfer roller.

It is an object of the invention to provide improved means and methods for electrostatically transferring very small toner particles, that is, particles having a mean diameter from about 2 to about below 8 micrometers, from a primary image member to a receiver sheet.

SUMMARY OF THE INVENTION

We have found that unexpectedly good transfer of electrophotographically produced images using small toner particles occurs when the image is developed on an electrostatographic recording member, preferably an organic photoconductive element, which has been overcoated with a thin (10 nm to 10 μm thick) layer of a material having a Young's modulus greater than 10 GPa and preferably greater than 100 GPa. The image is then transferred to an intermediate member which is comprised of an elastomeric blanket between about 0.1 cm and about 3 cm thick, having a Young's modulus between about 0.5 MPa (MPa is mega Pascals or $10^6$ Newtons per meter squared) and about 50 MPa, and preferably between about 1 MPa and about 10 MPa, and having an electrical resistivity between about $10^6$ ohm-cm and about $10^{12}$ ohm-cm, by applying an appropriate electrostatic potential between the transfer intermediate member and the photoconductive element so that the toner particles are urged to the intermediate member while the photoconductive element is pressed against the intermediate transfer member. Subsequently, the toned image is transferred from the intermediate transfer member to the receiver by applying an electrostatic field between the receiver and the intermediate transfer member so as to urge the toner particles toward the receiver while the receiver is pressed into contact with the intermediate transfer member. The blanket material comprising the intermediate transfer member should be overcoated with a thin (between about 0.1 μm and about 25 μm thick) layer of a material having a Young's modulus greater than about 100 MPa and preferably greater than about 1 GPa. The blanket overcoat comprises an integral, uniform coating or outer-skin of a material such as a thermoplastic, sol-gel, or ceramer. Alternatively, the coating can also be comprised of fine particles spaced closely enough together so as to substantially cover the surface of the blanket material. Alternatively, the coating can comprise a separate layer, such as a polyethylene terephthalate example of which are Kapton-H, sold by Dupont, or Estar, sold by Eastman Kodak Company, which has been tightly wrapped or otherwise attached to the blanket. The intermediate transfer member can be used in the practice of this invention in many forms, such as a web or a flat sheet. It is preferable, however, to use the intermediate in the form of a drum or cylinder.

In the practice of this invention it is preferable to transfer all separations from the photoconductive element to the intermediate in register, and subsequently transferring the image to the receiver in one step. However, if desired, the separations can be transferred separately to the receiver and registered on the receiver:

In the practice of this invention, any type of small toner particles, as are widely known in the literature, can be used. It is preferable, however, to use small toner particles bearing submicrometer particulate addenda on the surface of the toner particles. Appropriate addenda include silica, barium titanate, strontium titanate, and latexes.

DISCLOSURE OF THE PREFERRED EMBODIMENT

Figure 1:
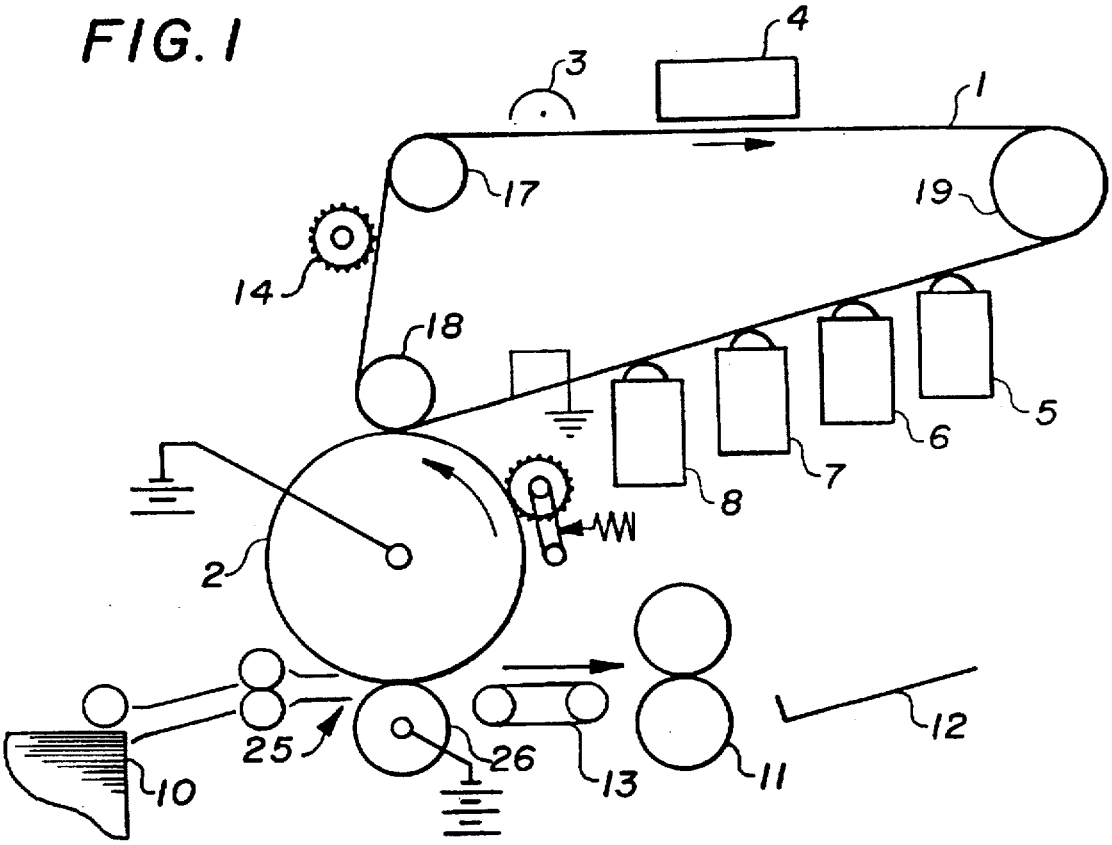
FIG. 1 is a side elevation in schematic of a color printer apparatus for practicing the invention.

FIG. 1 illustrates one preferred exemplary apparatus for carrying out the invention. A primary image member, for example, a photoconductive web 1 is trained about rollers 17, 18 and 19, one of which is drivable to move image member 1 past a series of stations well known in the electrophotographic art.

Figure 3:
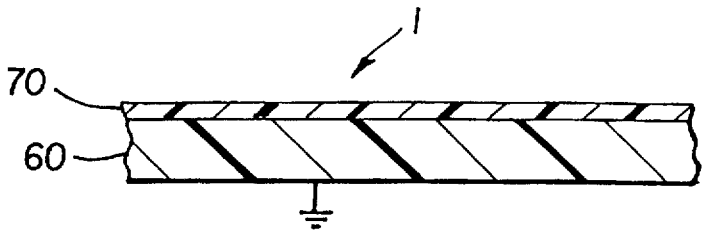
FIG. 3 is a cross-section of a portion of a photoconductor used in the apparatus of FIG. 1.

With reference also to FIG. 3, unexpected improved transfer efficiency of small toner particles is obtained by use of a hard overcoat 70 on a conventional organic photoconductor 60 of image member 1. A preferred hard overcoat is a sol-gel made by Optical Technologies, Inc. although other hard overcoat materials as noted above are useful, such as DLC, SiC, or possibly a ceramer. Thus, the outer layer of the photoconductor includes a thin (about 10 nm to about 10 μm thick) layer of a material having a Young's modulus greater than about 10 GPa and preferably greater than about 100 GPa. Primary image member 1 is uniformly electrostatically charged at a primary electrostatic charging station, such as a corona charging station 3, imagewise exposed at an exposure station 4, for example, by an LED printhead or laser electronic exposure station, to create a latent electrostatic image. The image is toned by one of toning stations 5, 6, 7 and 8 to create a toner image corresponding to the color of toner in the station used. The toner image is transferred from primary image member 1 to an intermediate image member, for example, intermediate transfer roller or drum 2 at a transfer station formed between roller 18, primary image member 1 and intermediate transfer drum 2. The primary image member 1 is cleaned at a cleaning station 14 and reused to form more toner images of different color utilizing toner stations 5, 6, 7 and 8. One or more additional images are transferred in registration with the first image to drum 2 to create a multicolor toner image on the surface of intermediate transfer drum 2. Although there are some mechanical advantages associated with the intermediate image member being a drum or roller, the invention can also be practiced if the intermediate image member is an endless web or a sheet or plate. Similarly, the primary image member can be a drum, sheet or plate as well as a web. A primary image member that is in the form of a drum can provide improved registration and thus is preferred where registration of colors is critical.

The multicolor image is transferred to a receiving sheet which has been fed from supply 10 into transfer relation with intermediate transfer drum 2 at a transfer station 25. The receiving sheet is transported from transfer station 25 by transport mechanism 13 to a fuser 11 wherein the toner image is fixed by conventional means such as heat or radiation. The receiver sheet is then conveyed from the fuser 11 to an output tray 12. The receiver sheet can be a cut sheet, as illustrated, or a continuous sheet fed from a roll. Intermediate transfer facilitates the use of a roll supply in color imaging because the receiver sheet does not have to recirculated to combine the color images. The invention is useful with a broad range of receiver sheets such as bond papers of 16 pound stock or heavier, graphic arts papers including clay-coated papers, polymer coated papers and non-paper receivers such as transparency stock and metallic sheets.

Each toner image is transferred from the primary image member 1 to the intermediate transfer drum 2 in response to an electric field applied between the core of drum 2 and a conductive electrode forming a part of primary image member 1. The multicolor toner image is transferred to the receiving sheet at transfer station 25 in response to an electric field created between a backing roller 26 and the transfer drum 2. Thus, transfer drum 2 helps establish both electric fields. As is known in the art, a polyurethane roller containing an appropriate amount of antistatic material to make it of at least intermediate conductivity can be used when establishing both fields. Typically, the polyurethane is a relatively thick layer, for example, about ¼ inch thick (about 0.635 cm) which has been formed on an aluminum base. The polyurethane is then coated with the thin overcoat or skin. Typically, the electrode buried in primary image member 1 is grounded for convenience in cooperating with other stations in forming the electrostatic and toner images. If the toner is a positively charged toner, an electrical bias applied to intermediate transfer drum 2 of typically −400 to −1,000 volts will effect substantial transfer of toner images to transfer drum 2. To then transfer the toner image onto a receiving sheet at transfer station 25, a bias, for example, of −3000 volts is supplied to backing roller 26 to again urge the positively charged toner to transfer to the receiving sheet. Schemes are also known in the art for changing the bias on drum 2 between the two transfer locations so that roller 26 need not be at such a high potential. In the transfer of the toner to the receiver sheet, it is preferred not to heat the toner so that the temperature of the toner remains below the toner's glass transition temperature during transfer.

Figure 2:
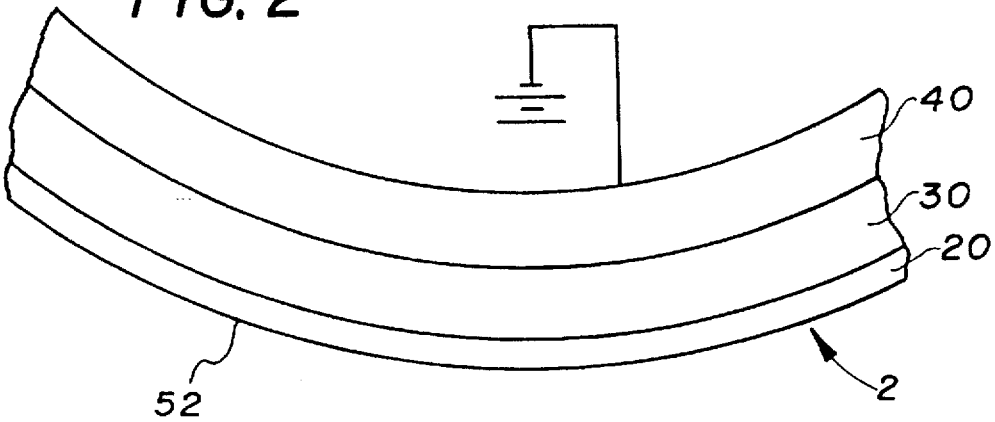
FIG. 2 is a cross-section of a portion of an intermediate transfer roller or drum used in the apparatus of FIG. 1

As disclosed in some of the examples in U.S. Pat. No. 5,084,735, a particular intermediate image transfer member is useful in improving the transfer of small toner particles. Referring to FIG. 2, intermediate transfer drum 2 has an elastomeric base or blanket 30 and a thin skin 20 (not shown to scale) coated or otherwise formed on it. The elastomeric base is supported on an aluminum core 40. The thin skin 20 defines an intermediate receiving surface 52 which receives the toner from the primary image member 1 and, in turn, passes it to the receiver sheet at transfer station 25. The elastomeric blanket is preferably between about 0.1 cm and about 3.0 cm thick and has a Young's modulus between about 0.5 MPa and about 50 MPa, and preferably between about 1.0 MPa and 10.0 MPa. The blanket is also characterized by an electrical resistivity between about $10^6$ ohm-cm and about $10^{12}$ ohm-cm. The blanket is preferably a polyurethane with a glass transition temperature of about −45° C. and sold by Conap, Inc., Olean, N.Y., under the name TU-500 and has a Young's modulus of 3.8 MPa. The blanket should be overcoated with a thin layer or skin (between about 0.1 μm and about 25 μm thick) of a material having a Young's modulus greater than about 100 MPa and preferably greater than about 1.0 GPa. The skin may be a thermoplastic, sol-gel, or preferably a ceramer. Alternatively, as noted above the skin may be comprised of fine particles or a tightly wrapped layer of a plastic such as a polyethylene terephthalate.

As noted in U.S. Pat. No. 5,370,961, transfer can be further enhanced by utilizing the toners disclosed in commonly assigned U.S. patent application Ser. No. 07/843,587, now abandoned, by McCabe. The patent application of McCabe describes a toner comprising very small particles of pigmented thermoplastic resin having on their surfaces a coating of extremely small particles which are applied to an aqueous dispersion in a uniform distribution and are strongly adhered to the toner particles. These extremely small particulate addenda particles may comprise colloidal silica, aluminum oxide, barium titanate, strontium titanate, latices or a latex polymer or copolymer, etc., of a size less than about 0.4 micrometers which, when properly adhering to the toner particles, can assist in the transfer of such toner particles. Addenda particles of about 0.2 micrometers or less are preferred.

Preferably, in addition to having a very thin skin of a relatively hard material on the relatively soft base material of the intermediate image-transfer member, the intermediate image transfer member's image receiving surface 52 is made extremely smooth for use with small particles. More specifically, it is preferable that the intermediate's receiving surface 52 has a roughness average less than the mean diameter of the toner particles. For very highest efficiencies, a roughness average substantially less than the toner particle size is preferred. For example, it is believed that a roughness average of about 0.5 micrometers of intermediate's receiving surface 52 would provide superior results with 3.5 micron toner (less than 20% of the mean particle size). Although it is believed increased smoothness will provide the best results, the invention is also applicable to surfaces that are somewhat less smooth.

While the invention is not limited to toners made by any particular method, it is preferred to use toners made by a chemical preparation process rather than those made for example by grinding. Chemical preparation may include emulsion polymerization, suspension polymerization, limited coalescence, evaporative limited coalescence, or spray drying from solution. Moreover, the particles can be formed by dissolving the polymeric binders in an appropriate solvent prior to the particle formation such as occurs in the evaporative limited coalescence and spray drying processes or the particles can be formed directly from the monomers, as they would be in the limited coalescence and emulsion polymerization processes. These techniques are widely known in the literature. As noted above, it is preferred to use small toner particles bearing submicrometer particulate addenda on the surface of the toner particles.

Although the reason for unexpected improvement in transfer efficiency of chemically prepared toners is not fully understood, it is believed to be due to the differences in shape between the chemically prepared toner particles and the more traditionally prepared ground particles. More specifically, ground toner particles generally exhibit concoidal fracture patterns, whereas the chemically prepared toner particles are more spherical, spheroidal, or raisin-shaped. This will affect the adhesion of these particles to both the photoconductive element and the intermediate transfer member due to the extent of the adhesion and applied load induced deformations of the materials.

An example of a chemically prepared small toner with silica addenda is described by Zaretsky et al in U.S. Pat. No. 5,370,961.

In the following examples the control photoconductive element consisted of a commercially available organic photoconductor used in the KODAK EKTAPRINT1575 Copier/Printer, produced by Eastman Kodak Company, Rochester, N.Y.

Neutral density step patches were developed in a typical electrophotographic manner using a two-component developer in a development station similar to that used in the KODAK EKTAPRINT 1575 Copier/printer. The toner had an average diameter of 5 μm. Transfer efficiencies were determined by measuring the amount of transferred and untransferred toner using transmission densitometry.

EXAMPLE 1

Figure 4:
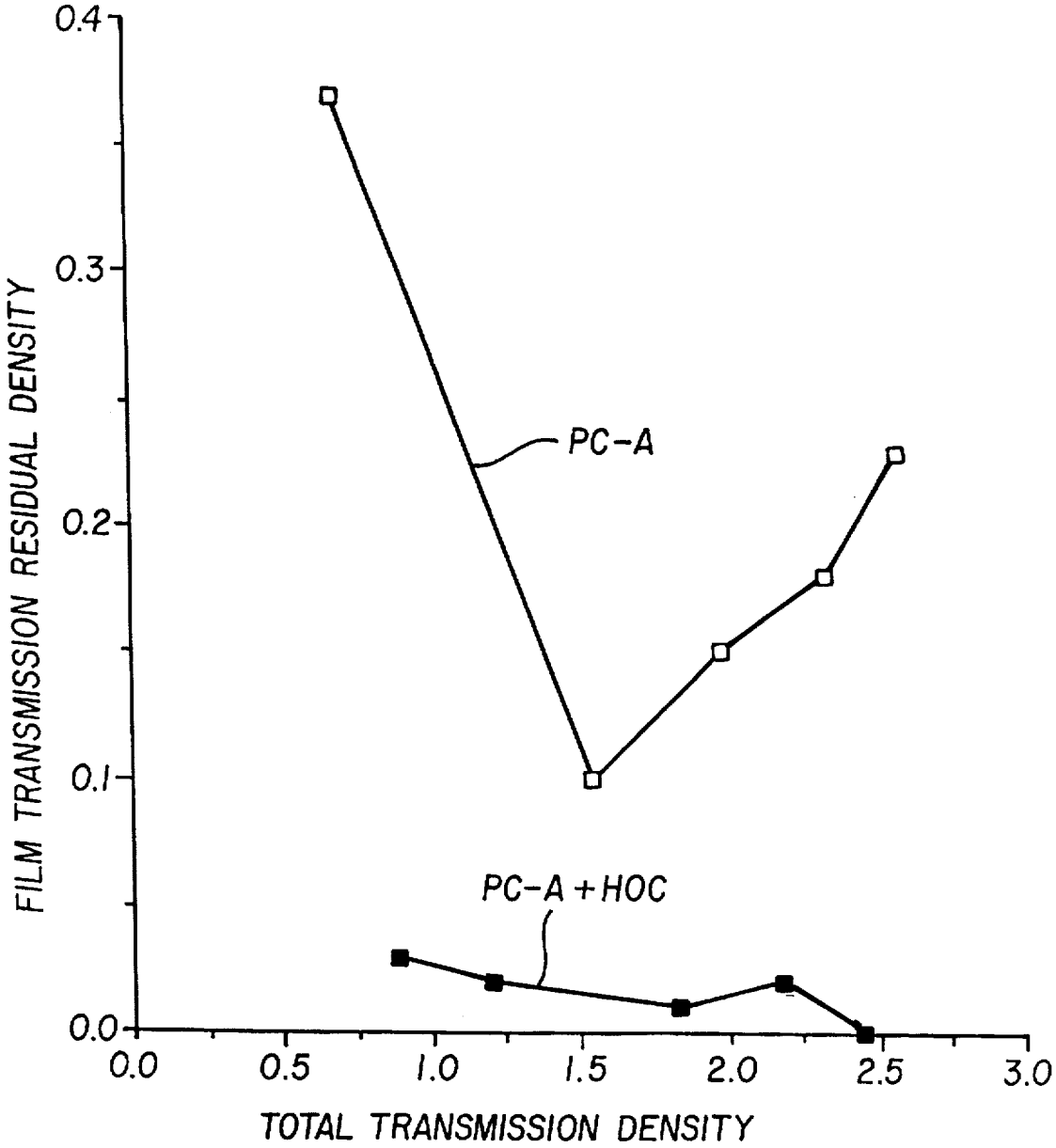
FIGS. 4–10 are graphs illustrating results of experiments described in the specification.
Figure 5:
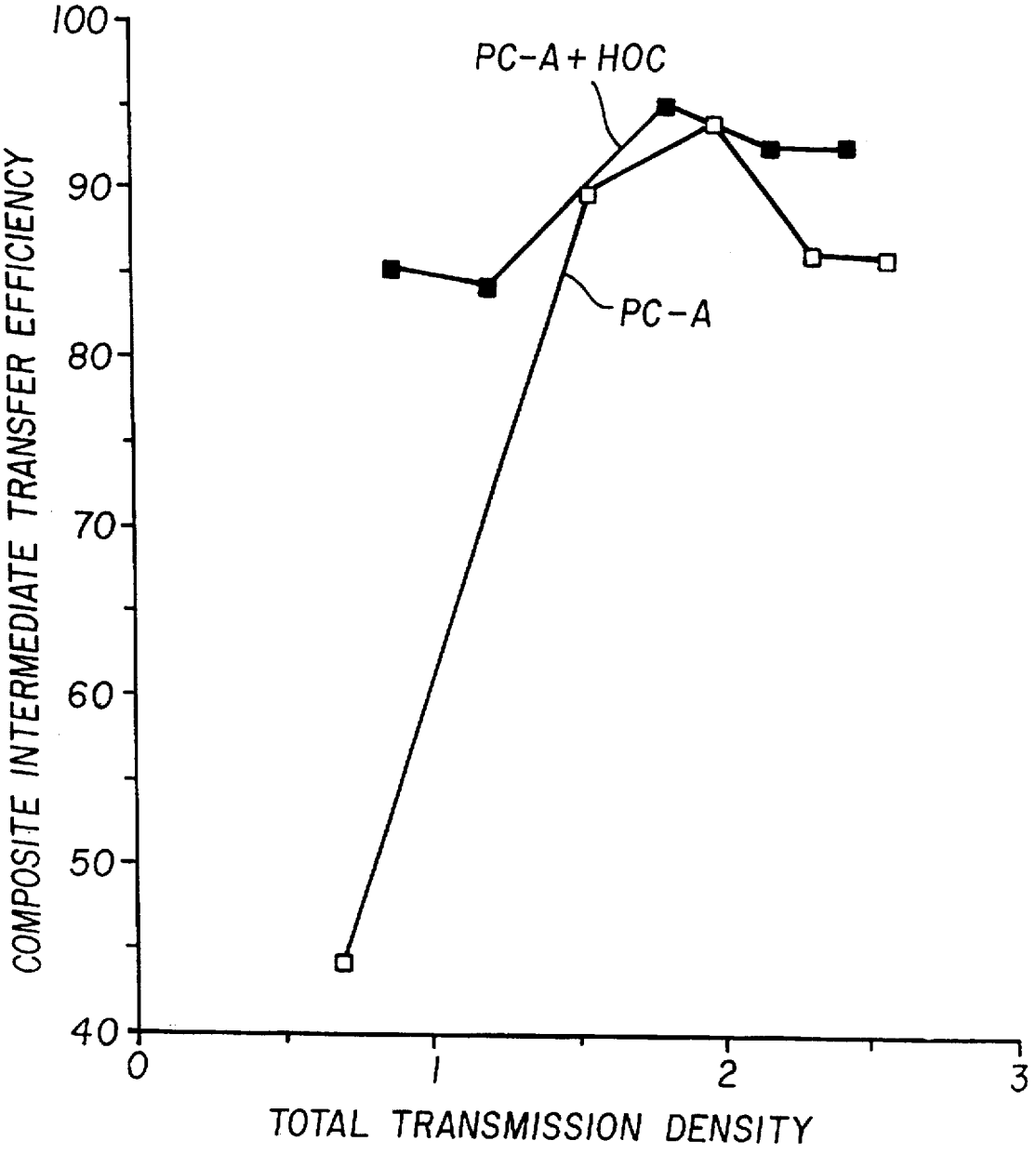

An intermediate transfer roller was made fitting the requirements described in this disclosure. The blanket overcoat on the intermediate roller consisted of submicrometer diameter particles of silica, sold by Cabot as "Cab-O-Sil". Two samples of organic photoconductive elements were used. The first was the commercially available photoconductor described previously and designated as "PC-A". The second was this exact same material overcoated with a commercially available sol-gel material, sold by Optical Technologies, Inc., which had been coated and cured, and is designated as "PC-A+HOC". The applied transfer voltage was adjusted to optimize the transfer efficiency, FIG. 4 shows the residual density on the photoconductive element after transfer, as a function of image transmission density. As is apparent, there is significantly less residual density on the sol-gel overcoated photoconductor than on the control. FIG. 5 shows the composite transfer efficiency, which is the product of the transfer efficiencies both to the intermediate from the photoconductor and to the receiver from the intermediate. As can be seen, the composite transfer efficiency is higher with the sol-gel overcoated photoconductor.

EXAMPLE 2

Figure 6:
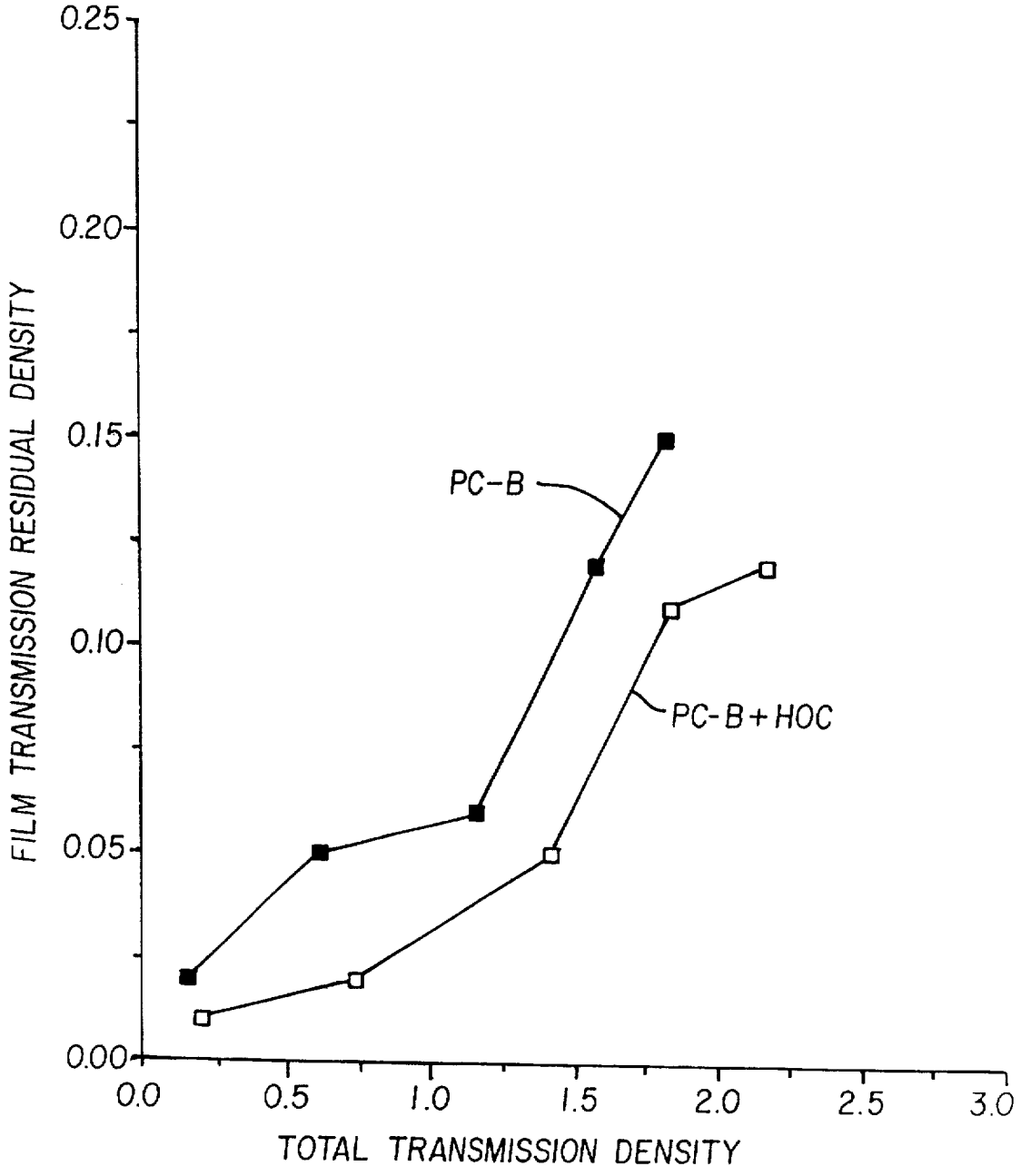
Figure 7:
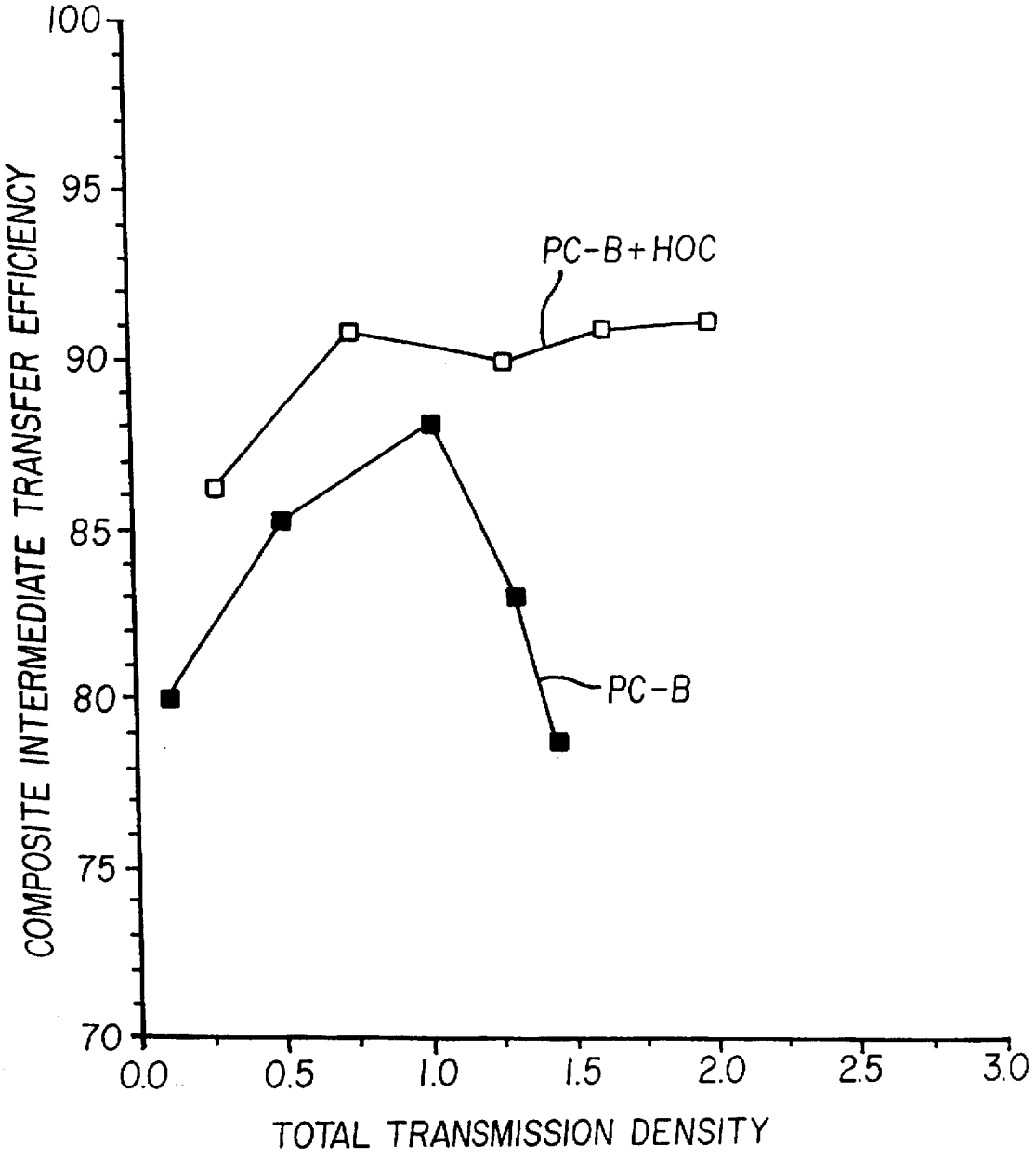

This is similar to example 1 except that the intermediate blanket overcoat is comprised of a thermoplastic sold as "Permuthane", a polyurethane made by Stahl Finish, Inc. and a different organic photoconductor from that used in the experiment of example 1 was used. The photoconductor used in Example 2 is referred to as PC-B and its transfer characteristics are compared with an identical photoconconductor that is covered with a hard overcoat. In this instance, a hard overcoat on PC-B+HOC consisted of an overcoat of silicon carbide formed by plasma-enhanced chemical vapor deposition on the organic photoconductor. As may be seen in FIGS. 6 and 7, there is, after transfer, more residual toner on the uncoated photoconductive element than on the coated one and the composite transfer efficiency is lower with the uncoated photoconductor PC-B.

EXAMPLE 3

Figure 8:
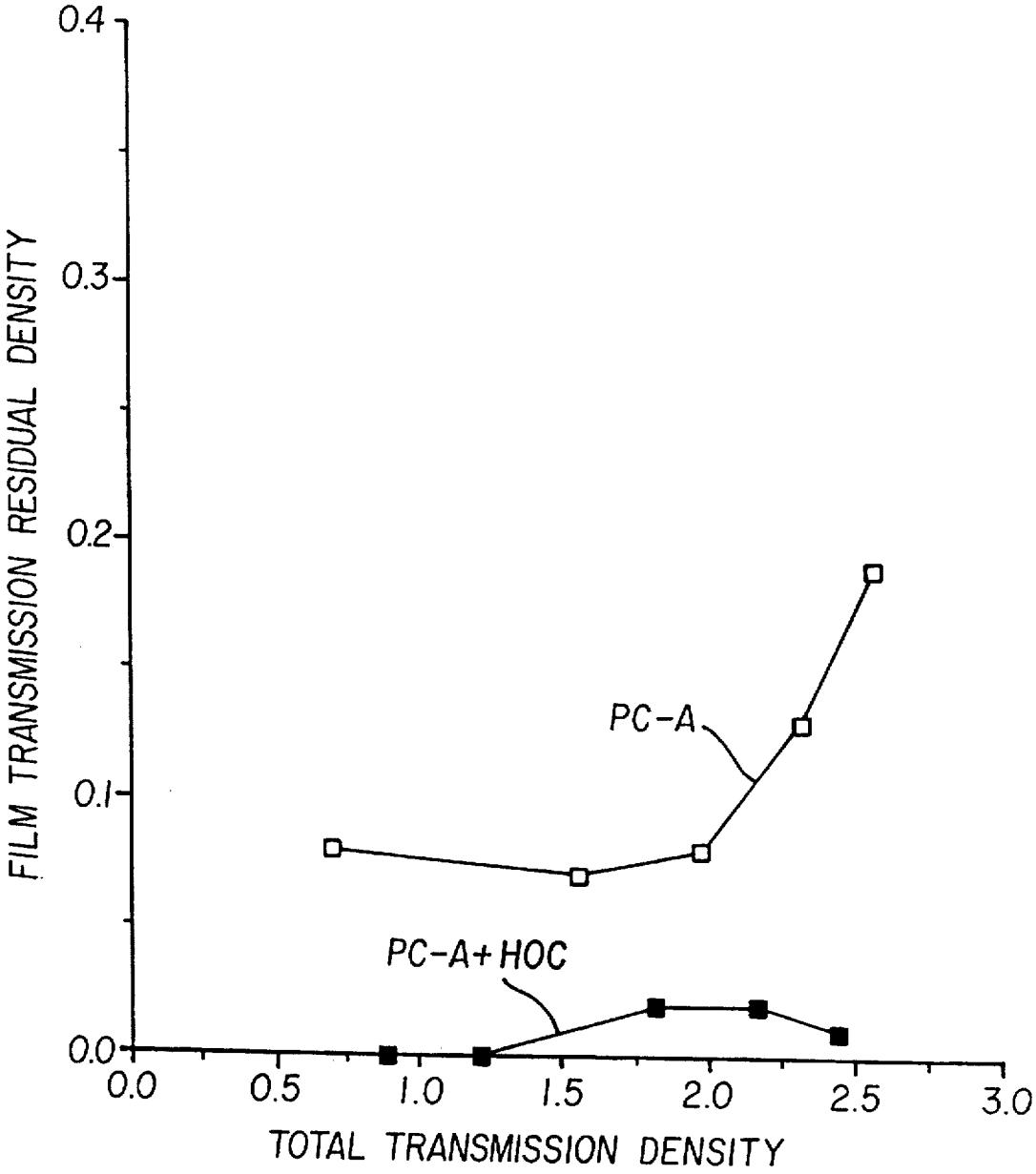
Figure 9:
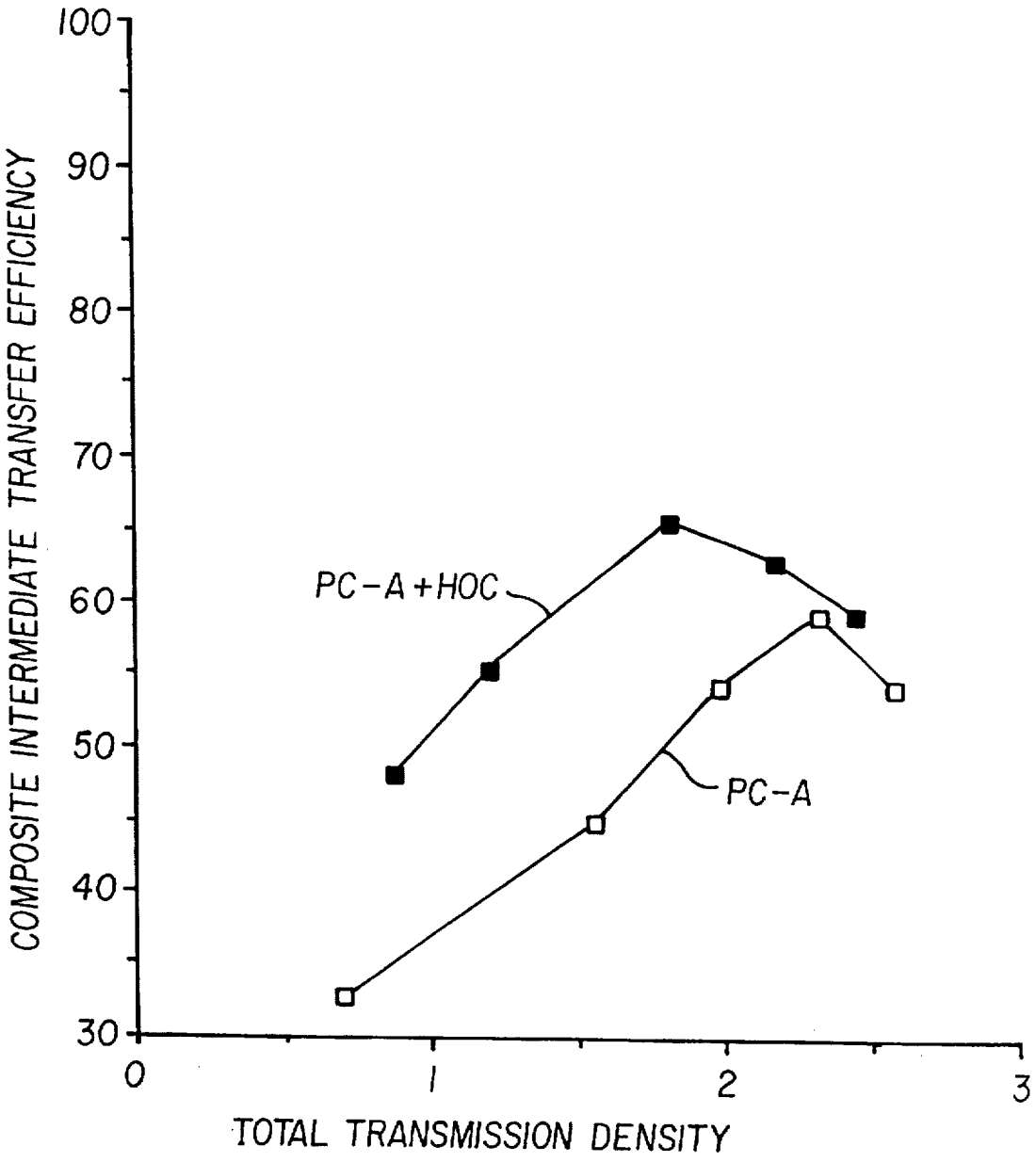
Figure 10:
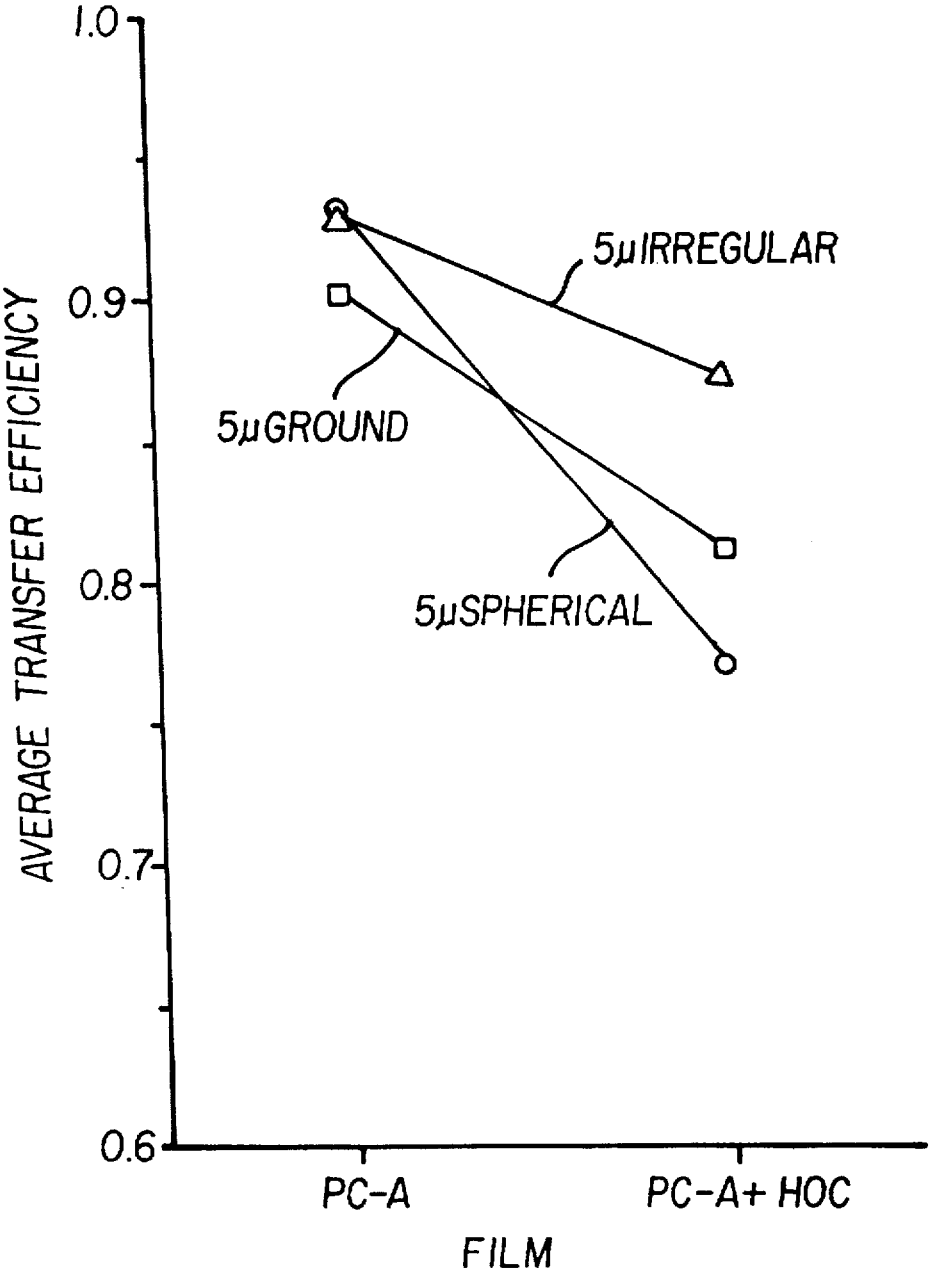

This example is similar to example 1 except that the intermediate did not have an overcoat covering the elastomeric blanket. As before, transfer to the intermediate was better with the sol-gel coated photoconductor (PC-A+HOC) than with the control (no hard overcoat) photoconductor (PC-A), as shown in FIG. 8. And, even though the composite intermediate transfer density is greater with the overcoated film (see FIG. 9), the efficiency is still too low to result in acceptable image quality with small toner particles. This example is thus outside the description of our invention because the intermediate is not comprised of a high Young's modulus thin overcoating material.

There has thus shown been described an improved method and apparatus for transferring small particle toned images from a primary image member to a receiver sheet. The prior art's direction of using release agents on the primary image member while effective is not desirable.

Contrary to expectations, primary image members with thin hard overcoats are shown to be effective for transfer when used with compliant intermediates and small particle dry toners having micrometer particulate addenda. While the reasons for the unexpected success of such transfer are not known, it is believed that the hard overcoat minimizes the amount of adhesion-induced deformation of the primary (photoconductor) and intermediate image members thereby facilitating particle transfer; i.e., as the primary and intermediate image members engage in contact for transfer, there is less deformation allowing the toner to transfer.

We claim:

1. A method of forming a toner image on a receiver sheet, which method comprises:

forming an electrostatic latent image on a primary image member, the primary image member having an outer layer of a thickness less than about 10 μm and the outer layer being characterized by a Young's modulus greater than about 10 GPa;

toning said latent image with a dry toner to form a toner image on the outer layer, the toner being characterized by a mean volume weighted diameter that is between about 2 μm and less than about 8 μm;

transferring said toner image from said primary image member to an intermediate image member in the presence of an electric field urging toner particles from said primary image member to said intermediate image member wherein said intermediate image member has a relatively compliant base, and a thin, hard outer skin defining the outside surface of said intermediate image member the outer skin being characterized by a Young's modulus of greater than about 100 MPa; and transferring said toner image from said intermediate image member to a receiver sheet in the presence of an electric field urging toner particles from said intermediate image member to said receiver sheet.

2. The method of claim 1 wherein the outer layer of the primary image member is characterized by a Young's modulus greater than about 100 GPa.

3. The method of claim 2 wherein the thickness of the outer layer is greater than about 10 nm and the primary image member comprises an organic photoconductive element.

4. The method of claim 3 and the toner includes submicrometer particulate addenda.

5. The method of claim 4 wherein the compliant base of the intermediate image member is about 0.1 cm to about 3 cm thick.

6. The method of claim 3 wherein the compliant base of the intermediate image member is about 0.1 cm to about 3 cm thick.

7. The method of claim 6 wherein the compliant base of the intermediate image member is characterized by a Young's modulus of between about 0.5 MPa to about 50 MPa.

8. The method of claim 7 wherein the compliant base of the intermediate image is characterized by an electrical resistivity of between about $10^6$ ohm-cm and about $10^{12}$ ohm-cm.

9. The method of claim 7 wherein the compliant base of the intermediate image member is characterized by a Young's modulus of between about 1 MPa to about 10 MPa.

10. The method of claim 9 wherein the compliant base of the intermediate image member is characterized by an electrical resistivity of between about $10^6$ ohm-cm and about $10^2$ ohm-cm.

11. The method of claim 10 wherein the hard outer skin of the intermediate image member is between about 0.1 μm and about 25 μm in thickness.

12. The method of claim 10 wherein the hard outer skin of the intermediate image member is between about 0.1 μm and about 25 μm in thickness and is characterized by a Young's modulus of at least about 1 GPa.

13. The method of claim 12 wherein the photoconductive element comprises a polymeric binder.

14. The method of claim 1 wherein the primary image member is an organic photoconductor, thee outer layer of the primary image member having a thickness of between about 10 nm and about 10 μm.

15. The method of claim 1 wherein the primary image member is an organic photoconductor, the outer layer of the primary image member has a thickness of between about 10 nm and about 10 μm; the compliant base of said intermediate image member is between about 0.1 cm to about 3 cm in thickness and characterized by a Young's modulus of between about 0.5 MPa and about 50 MPa and an electrical resistivity of between about $10^6$ ohm-cm and about $10^{12}$ ohm-cm, and the outer skin has a thickness of between about 0.1 μm and about 25 μm.

16. The method of claim 15 and wherein the outer layer of the primary image member is selected from the group consisting of sol-gel, silicon carbide and diamond-like carbon.

17. The method of claim 16 and the toner includes submicrometer particulate addenda.

18. A method of forming a multicolor toner image on a receiver sheet, which method comprises:

forming a series of electrostatic latent images on a primary image member, the primary image member having an outer layer of a thickness less than about 10 μm and the outer layer being characterized by a Young's modulus greater than about 10 GPa;

toning said latent images with different dry toners to form a series of different color toner images on the outer layer, the toner being characterized by a mean volume weighted diameter that is between about 2 μm and less than about 8 μm;

transferring said different color toner images from said primary image member to an intermediate image member in the presence of an electric field urging toner particles from said primary image member to said intermediate image member, said toner images being transferred in registration to form a multicolor toner image on the intermediate member, wherein said intermediate image member has a relatively compliant base and a thin hard outer skin defining the outside surface of said intermediate image member, the outer skin being characterized by a Young's modulus of greater than about 100 MPa; and transferring said multicolor toner image from said intermediate image member to a receiver sheet in the presence of an electric field urging toner particles from said intermediate image member to said receiver sheet.

19. The method of claim 18 wherein the primary image member is an organic photoconductor.

20. The method of claim 19 and the toner includes submicrometer particulate addenda.

21. A method of forming a toner image on a receiver sheet which method comprises:

forming on a composite primary image member, the primary image member having an outer layer of a thickness less than about 10 μm and the outer layer being characterized by a Young's modulus greater than about 10 GPa, an unfused toner image with a dry toner on the outer layer, the toner being characterized by a mean volume weighted diameter that is between about 2 μm and less than about 8 μm;

transferring said toner image from said primary image member to a composite intermediate image member in the presence of an electric field urging toner particles from said primary image member to said intermediate image member wherein said intermediate image member has a relatively compliant base, and a thin, hard outer skin defining the outside surface of said intermediate image member, the outer skin being characterized by a Young's modulus of greater than about 100 MPa; and transferring said toner image from said intermediate image member to a receiver sheet.

22. The method of claim 21 where the primary image member comprises an organic photoconductor.

23. The method of claim 21 wherein the primary image member is an organic photoconductor, the outer layer of the primary image member has a thickness of between about 10 nm and about 10 μm; the compliant base of said intermediate image member is between about 0.1 to about 3 cm in thickness and characterized by a Young's modulus of between about 0.5 MPa and about 50 MPa and an electrical resistivity of between about $10^6$ ohm-cm and about $10^{12}$ ohm-cm, and the outer skin has a thickness of between about 0.1 μm and about 25 μm.

24. The method of claim 19 and wherein the outer layer of the primary image member is selected from the group consisting of sol-gel, silicon carbide and diamond-like carbon.

25. The method of claim 1 wherein the hard outer skin of the intermediate image member is between about 0.1 μm and about 25 μm in thickness.

26. The method according to claim 25 wherein the compliant base of said intermediate image member is between about 0.1 cm to about 3 cm in thickness and characterized by a Young's modulus of between about 0.5 MPa and about 50 MPa.

* * * * *